US006796738B2

(12) United States Patent
Dengler

(10) Patent No.: US 6,796,738 B2
(45) Date of Patent: Sep. 28, 2004

(54) LOOP-TYPE BINDER FOR DOCUMENTS

(76) Inventor: Wolfgang Dengler, Dieffenbachstrasse 28, D-10967, Berlin (DE)

( * ) Notice: Subject to any disclaimer, the term of this patent is extended or adjusted under 35 U.S.C. 154(b) by 66 days.

(21) Appl. No.: 10/219,454

(22) Filed: Aug. 15, 2002

(65) Prior Publication Data

US 2003/0053848 A1 Mar. 20, 2003

(30) Foreign Application Priority Data

Aug. 22, 2001 (DE) ..... 101 42 824

(51) Int. Cl.[7] ..... B42F 3/00; B42F 13/02

(52) U.S. Cl. ..... 402/8; 402/7; 402/13; 402/19; 402/22; 402/68; 402/70; 402/80 R; 281/15.1; 24/67 R

(58) Field of Search ..... 402/7, 8, 13, 19, 402/22, 68, 70, 80 R; 24/67 R; 281/15.1

(56) References Cited

U.S. PATENT DOCUMENTS

| | | | | | |
|---|---|---|---|---|---|
| 2,773,504 | A | * | 12/1956 | McGervey | 402/8 |
| 4,437,781 | A | * | 3/1984 | Weihe et al. | 402/8 |
| 4,784,507 | A | * | 11/1988 | Vetter | 402/13 |
| 4,940,352 | A | * | 7/1990 | Kratzert et al. | 402/13 |
| 5,827,003 | A | | 10/1998 | Konig | |

FOREIGN PATENT DOCUMENTS

| | | | | |
|---|---|---|---|---|
| CH | 516411 | * | 1/1982 | |
| DE | 1229498 | * | 12/1966 | |
| DE | 25 17 208 | A1 | 10/1976 | |
| DE | 2612625 | A1 * | 9/1977 | |
| DE | 2365970 | A1 * | 10/1977 | |
| DE | 274618 | A1 * | 12/1978 | |
| DE | 2947609 | A1 * | 5/1981 | |
| EP | 05 17 108 | | 12/1992 | |
| FR | 2650538 | A1 * | 2/1991 | ..... B42F/13/10 |
| GB | 919032 | * | 2/1963 | |
| GB | 1052270 | * | 12/1966 | |
| GB | 1097272 | * | 1/1968 | |
| GB | 2205278 | * | 12/1988 | |
| JP | 1010-00577 | | 4/1998 | |

* cited by examiner

*Primary Examiner*—Andrea L. Wellington
(74) *Attorney, Agent, or Firm*—Webb Ziesenheim Logsdon Orkin & Hanson, P.C.

(57) ABSTRACT

A loop-type binder comprises tongues (4) attached on its back cover for holding document sheets, and these tongues (4) constantly increase in thickness from their base (6) to their tip (9), thus comprising a deflection resistant tip and an elastic staff at their base. The radius of the joining area (15) from the tongue to the base is by several times smaller on the side facing the back cover than the radius of the joining area (14) on the side that faces the front cover. The stopper (13) that retains the tongue when the binder is open is integrated into the tongue by a slope (12). This tongue design facilitates convenient and gentle handling and storage of documents (FIG. 2).

11 Claims, 2 Drawing Sheets

4
11
12
13
9

6
15
8
14
4

9
4
13
12
10
11
7
14
15
6

11
10
4
14
15
8
7
6

LOOP-TYPE BINDER FOR DOCUMENTS

BACKGROUND OF THE INVENTION

1. Field of the Invention

This invention relates to a loop-type binder for punched document sheets, consisting of a back cover onto which elastic tongues are mounted for filing sheets and of a front cover with eyelets opposite these tongues into which the tongues engage and in which the tongues are retained using a stopper.

2. Description of the Related Art

Such binders for filing sheets of paper are known, for example, from German patent DE 195 27 872 A1. The tongues are locked into place on the back cover by means of a base comprising a latch element. The tongue end connected to the base has the design of a laminated spring, and the tongue comprises a reduction in width (waist) in its center section and a bulge on its back that faces the back cover. This design is to ensure that the tongues form a ring when the binder is open and are elastically retained in the eyelets so that any sheets filed on them can be turned over conveniently and without being damaged. However, when the binder is closed, this design is to prevent any restoring forces from applying to the front cover which would result in keeping it slightly open.

This problem of restoring forces acting on the covers indeed remains unsolved with known loop-type binders. When the joint between the tongue and the base is thin and the elastic effect on the front cover is low, the curvature required for easy turning over sheets is not fully developed, and document sheets may got caught in the joining area between the base and the tongue or even be damaged. If the tongue or some of its parts are not stiff enough, it may also be more difficult to file the punched paper on them. Finally, a weak joint can be damaged after long-term use. Another disadvantage of the known binders with tongues is that the stoppers provided for preventing the tongues from sliding out may damage the documents despite their relatively small height, especially when the closed binder is exposed to pressure that presses the stoppers into the sheets.

It is the problem of this invention to provide a loop-type binder as described above with tongues whose design ensures convenient and safe handling of the binder and the document sheets stored in it.

SUMMARY OF THE INVENTION

The major idea of the invention is that the tongue increases in thickness from its root to its tip and that an indent or slope of a limited length is molded into the thicker tongue area that gradually inclines towards the tip and at its end comprises a stopper surface that is molded into the tongue. The joining area between the tongue and the base connected to it in one piece has a large radius on the side facing the front cover of the binder while this same area between the tongue surface facing the back cover of the binder and the base is rather small in radius.

The tongue design according to the invention causes the tongues to bend in a well-formed curvature when the binder is open and the tongues are retained in their eyelets so that the document sheets can conveniently be turned over and do not get caught or damaged. When the binder is closed, however, the restoring forces of the tongues that act on the front cover are small, which means that the cover of the loop-type binder will not be lifted. Furthermore, the stopper that is molded into each tongue will not produce any imprints in the document sheets, as protruding stoppers would commonly do. This way of integrating the stopper into the tongue is possible due to the increasing material thickness of the tongue towards the tip. And finally the proposed tongue design has the advantage that the free end of the tongue is particularly deflection resistant, which makes filing new document sheets onto them easy.

BRIEF DESCRIPTION OF THE DRAWINGS

Although the stopper is not integrated into the tongue in this embodiment, the tongue design ensures convenient and safe binder and document handling. An embodiment of the invention is explained in greater detail below with reference to the figures. Wherein.

DETAILED DESCRIPTION OF THE PREFERRED EMBODIMENTS

Figure 1:
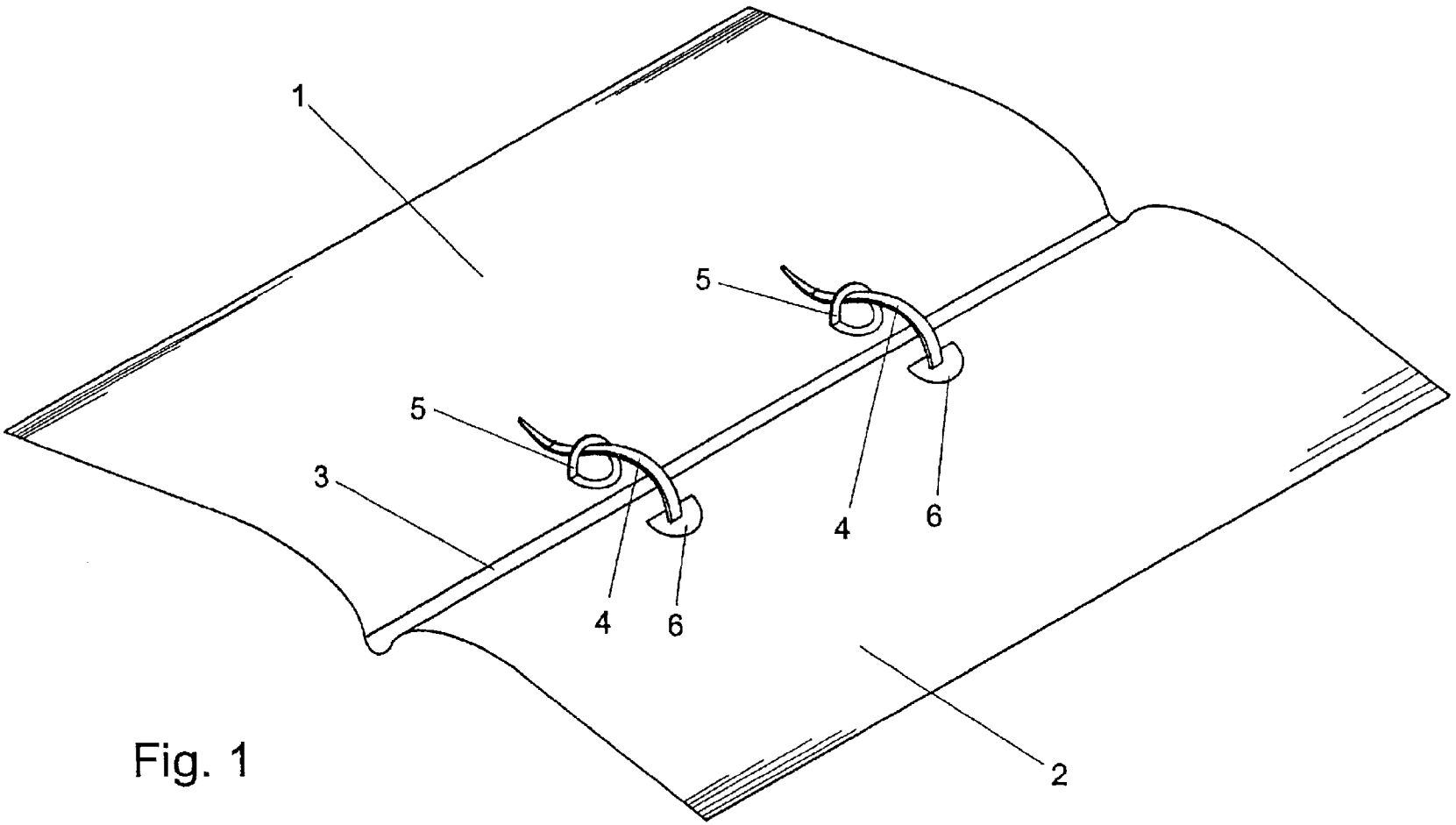
FIG. 1 is a view of a loop-type binder when opened.

As FIG. 1 shows, a loop-type binder consists of a front cover 1 and a back cover 2 that are connected via a spine 3. In the filing section close to the spine 3, two elastic tongues 4 are provided on the back cover 2 at the common punching spacing for a sheet of paper. The inside of the front cover features eyelets 5 opposite the tongues 4 in which the tongues 4 are flexibly guided when the loop-type binder is opened or closed. When sheets of paper are added, the elastic tongues are pulled out of the eyelets. The elastic tongues 4 straighten themselves up so that punched sheets of documents can be filed easily. Subsequently, the tongues 4 are inserted into the opposite eyelets to form loops on which the sheets of paper are held safely. When the loop-type binder is closed, the tongues are resting against the document sheets.

As can be seen from FIGS. 2 through 5, the tongues are connected in one piece to a base designed for being welded onto the back cover. The support surface of the base 6 features multiple welding projections 7 and a generally peripheral welding lip 8 around its brim for forming a defined weld to facilitate an easy and stable welded connection to the back cover 2. The base 6 may alternatively be designed for an interlocking connection with the cover 2 such as a latch.

The top view represented in FIG. 1 shows that the tongues 4 are tapered towards their rounded tips 9 relative to the surfaces 10, 11 running in parallel to the front and back covers 1, 2. A stopper 13 that prevents the respective tongue 4 from slipping out of its associated eyelet 5 is integrated into the surface 11 of each tongue 4 facing the back cover 2 (and resting on the document sheets when the binder is closed). The surface 10 facing the front cover 1 has the form of a straight line according to the sectional view in FIG. 2 while the surface 11 facing the document sheets or the back cover 2 shows a general rise from the base 6 to the tip 9. This means that the tongue 4 becomes more and more stable or less elastic towards the tip 9 except the portion in which the material gradually becomes thinner in a slope 12 to form the stopper 13 that is molded into the surface 11.

The consistently conical shape of the tongue 4 from its root to its tip 9 makes filing documents easier. The thick tip 9 provides deflection resistance which makes threading pages onto the tongues even easier. The gradual increase in material thickness starting from the root and including the slope 12 to the stopper 13 causes a defined curvature of the tongue 4, which ensures convenient turning over of filed document sheets when the loop-type folder is open. And finally it is this increase in thickness towards the tip that makes it feasible to integrate the stopper 13 into the surface 11 so that it does not protrude from surface 11. This design eliminates any damage to the filed documents by the stopper 13.

Figures 2, 3, 4, 5:
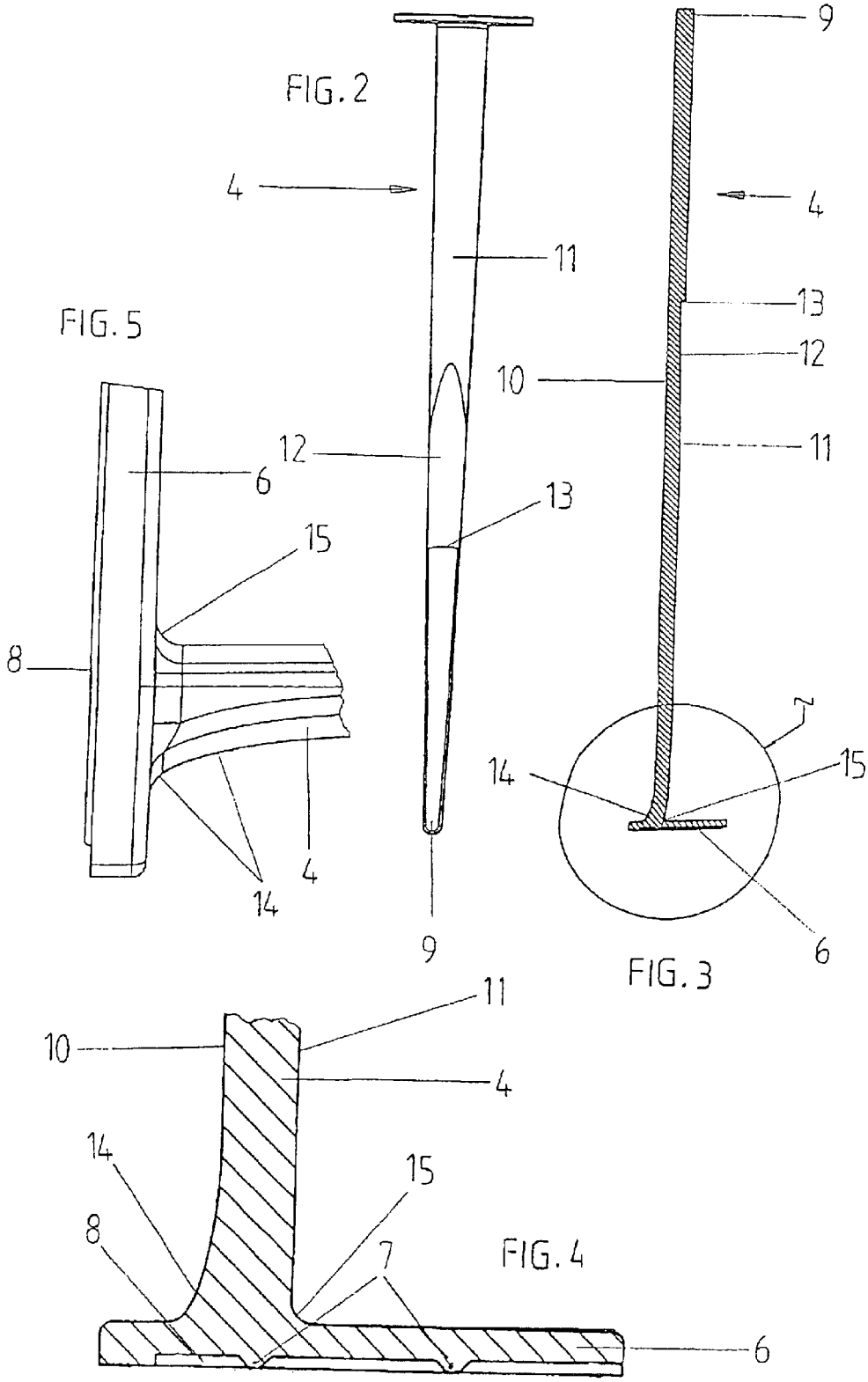
FIG. 2 is a top view of a tongue according to the invention of a loop-type binder.
FIG. 3 is a lateral sectional view of the tongue shown in FIG. 2.
FIG. 4 shows the base of a tongue as a detail Z of FIG. 3.
FIG. 5 is a lateral view of the tongue base for a welded connection with the cover.

The connection of the tongue 4 to the base 6 is shown in FIGS. 4 and 5. The joining area 14 between the surface 10 facing the front cover 1 and the base 6 is characterized by a greater radius whereas the the radius of the joining area 15 between the back cover 2 or the surface 11 facing the documents and the base 6 is considerably smaller. This small radius enhances easy resting of the tongue 4 on the documents and reduces any restoring forces that act on the front cover 1. The greater radius of the joining area 14, however, facilitates a well-formed curvature of the tongue 4 when held in the eyelets and when the loop-type binder is open. This curvature starts right at the base 6 and lets the user turn over filed away sheets of paper without the sheets getting caught or torn.

I claim:

1. A loop-type folder for punched sheets of documents, consisting of a back cover to which elastic tongues for filing sheets of documents are attached by means of a base at a joining area, and a front cover featuring eyelets opposite said elastic tongues in which these are guided and against which a stopper facing the back cover prevents these tongues from sliding out, wherein the tongue has a material thickness which constantly increases from the base to a tip and that said stopper forms a stopping surface that is molded into the tongue in a thinner, limited-length section, and that a radius of a joining area between a surface facing the back cover and the base is several times smaller than a radius of a joining area between the surface facing the front cover and the base.

2. The loop-type folder according to claim 1, wherein the thinner section is formed by a slope in the tongue that inclines towards a stopping surface.

3. The loop-type folder according to claim 1, wherein the stopping surface inclining into the tongue is at an angle equal to or smaller than 90° with the adjacent surface of the tongue.

4. The loop-type folder according to claim 1, wherein each tongue has a tapering towards a tip formed by a steadily decreasing width.

5. The loop-type folder according to claim 1, wherein the tongue has sides and a tip and wherein the sides and the tip of the tongue are rounded.

6. The loop-type folder according to claim 1, wherein the base and the covers are made of plastic and joined by welding.

7. The loop-type folder according to claim 1, wherein the base is attached to the back cover by a latch.

8. The loop-type folder according to claim 1, wherein the base is attached to the back cover by a plug-type connection.

9. The loop-type folders according to claim 6, wherein the base comprises a peripheral welding lip along its brim on a surface facing the back cover and dot-shaped welding projections in an area encompassed by said welding lip.

10. A loop-type folder for punched sheets of documents, comprising a back cover to which elastic tongues for filing sheets of documents are attached by means of a base, and a front cover featuring eyelets opposite said elastic tongues through which these are guided and against which a stopper facing the back cover prevents these tongues from sliding out, wherein the tongue has a material thickness which remains generally constant from the base to a tip to provide flexibility and that an area adjacent to the tip is reinforced by a one-sided increase in material thickness to form a stopper, and that a radius of a joining area between a surface facing the back cover and the base is several times smaller than a radius of a joining area between the surface facing the front cover and the base.

11. A loop-type folder for punched sheets of documents, comprising a back cover to which elastic tongues for filing sheets of documents are attached by means of a base at a joining area, and a front cover featuring eyelets opposite said elastic tongues in which these are guided and against which a stopper facing the back cover prevents these tongues from sliding out, wherein the tongue has a material thickness which constantly increases from the base to a tip and that said stopper forms a stopping surface that is molded into the tongue in a thinner, limited-length section, and a radius of a joining area between a surface facing the back cover and the base is several times smaller than a radius of a joining area between the surface facing the front cover and the base, wherein the base comprises a peripheral welding lip along its brim on a surface facing the back cover and dot-shaped welding projections in an area encompassed by said welding lip.

* * * * *